US006926129B2

(12) United States Patent
Hoberman

(10) Patent No.: US 6,926,129 B2
(45) Date of Patent: Aug. 9, 2005

(54) ROLLING DUFFEL BAG

(75) Inventor: Barry Hoberman, Coral Springs, FL (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 10/264,035

(22) Filed: Oct. 3, 2002

(65) Prior Publication Data

US 2004/0065518 A1 Apr. 8, 2004

(51) Int. Cl.[7] ..... A45C 7/02
(52) U.S. Cl. ..... 190/107; 190/18 A; 190/127
(58) Field of Search ..... 190/107, 18 A, 190/18 R, 127

(56) References Cited

U.S. PATENT DOCUMENTS

| | | | | | |
|---|---|---|---|---|---|
| 909,325 | A | * | 1/1909 | Patch | 190/107 |
| 2,191,557 | A | * | 2/1940 | Cline | 190/106 |
| 2,710,084 | A | * | 6/1955 | Braverman | 190/107 |
| 3,447,648 | A | * | 6/1969 | Schwennicke | 190/103 |
| 4,561,525 | A | | 12/1985 | Shidner | |
| 4,588,056 | A | | 5/1986 | Bernbaum | |
| 4,629,040 | A | | 12/1986 | Jones | |
| 4,813,520 | A | * | 3/1989 | Lin | 190/107 |
| 4,895,230 | A | | 1/1990 | King | |
| 4,951,818 | A | * | 8/1990 | Johnson | 206/315.1 |
| 5,197,580 | A | | 3/1993 | Berman et al. | |
| 5,476,184 | A | | 12/1995 | Hill | |
| 5,620,069 | A | | 4/1997 | Hurwitz | |
| 5,749,446 | A | * | 5/1998 | Hsieh | 190/107 |
| 5,782,325 | A | * | 7/1998 | O'Shea et al. | 190/18 A |
| 5,896,962 | A | | 4/1999 | Smith et al. | |
| 6,021,874 | A | * | 2/2000 | Nykoluk | 190/103 |
| 6,161,665 | A | | 12/2000 | Hoover | |
| 6,193,034 | B1 | | 2/2001 | Fournier | |
| 6,213,268 | B1 | | 4/2001 | Dancyger | |
| 6,227,339 | B1 | * | 5/2001 | Bogert | 190/18 R |
| 6,604,617 | B2 | * | 8/2003 | Davis et al. | 190/107 |

* cited by examiner

*Primary Examiner*—Tri M. Mai
(74) *Attorney, Agent, or Firm*—Sacco & Associates, PA

(57) ABSTRACT

An article of luggage, such as a rolling duffel, includes a base, opposing ends connected to the base and opposing sides connected to the base and the opposing ends. A top including a lid is connectable to the opposing sides and the opposing ends. The sides and top are formed of a deformable material. A reinforcing member extends substantially along the length of the top, so that the article of luggage may be stood on one of the opposing ends such that the other end is at least partially supported by the reinforced top. The top may be formed completely by the lid, and the reinforcing member may be a frame extending around the periphery of the lid. The reinforcing member may be formed of a rigid plastic material.

14 Claims, 4 Drawing Sheets

ROLLING DUFFEL BAG

BACKGROUND OF THE INVENTION

1. Statement of the Technical Field

The invention generally concerns rolling luggage and, more particularly, a rolling duffel bag.

2. Description of the Related Art

Rolling luggage has become increasingly popular in recent years. A common configuration for this type of luggage includes a container or case portion that is generally rectangular in shape in which one or more articles can be stored for travel. The container is typically comprised of a base, side walls, ends, and a lid. A wheel assembly is commonly provided to allow the container to be rolled rather than carried. The wheel assembly generally includes a pair of wheels mounted at an interface of the base and one of the ends of the luggage. A telescoping handle assembly is generally provided attached to the base. The telescoping handle assembly has at least one, and usually two, telescoping posts that can extend from the top panel of the container, which are connected by a handle for wheeling the luggage.

Typically, such rolling luggage configurations are suitcases, which have substantially rigid sides and/or a substantially rigid lid, however suitcases can be heavy, and take up a large amount of storage space when not in use. Duffel bags are also popular because of their lightweight, flexible construction and ability to store a large quantity of items. In addition, the flexible material allows the duffel bag to be folded or crumpled for storage. However, because duffel bags are formed of flexible materials, it is generally not possible to stand them on their wheeled end unless they are very full of items because the sides and lid tend to sag under the weight of the non-wheeled end, which can tip the duffel bag over due to the weight of the telescoping handle assembly, and because the telescoping handle assembly tends to be rigid and cannot also sag uniformly with the sides and lid. Duffel bags have therefore not been successfully formed into wheeled articles of luggage.

SUMMARY OF THE INVENTION

One arrangement of the invention concerns an article of luggage, such as a rolling duffel, including a base, opposing ends connected to the base and opposing sides connected to the base and the opposing ends. A top is connectable to the opposing sides and the opposing ends, and includes a lid. The sides and lid are formed of a deformable material. A reinforcing member extends substantially along the length of the top, so that the article of luggage may be stood on one of the opposing ends such that the other end is at least partially supported by the reinforced top.

In one embodiment, the top is formed completely by the lid. The reinforcing member may extend substantially along the length of lid, and in one arrangement may be a frame extending around the periphery of the lid. In other embodiments, the reinforcing member may be a cross-brace, lengthwise reinforcing bars, a ladder-like structure, a mesh or trellis structure, an I-shaped member, or any suitable shape. The reinforcing member may be formed of a rigid plastic material.

Wheels may be located adjacent to the base and one of the opposing ends. An extendable and retractable handle member may be provided adjacent to the base for towing the article on the wheels.

The lid may be hingedly attached to one of the opposing sides, and may be closable with a zipper. Alternatively, the lid may be removable from the article of luggage, hingedly attached to one of the opposing ends, or may form an aperture in the top.

At least one of the opposing ends may be foldable to the base for storage of the article. Preferably both of the opposing ends are foldable to the base. The foldable end may include a hinge to allow folding of the end to the base.

A foot may be provided on one of the opposing ends for stabilization of the article when stood on the end.

Another arrangement of the invention concerns an article of luggage which includes a substantially rigid base, a wheel assembly connected to the base, and a retractable handle assembly connected to the base for towing the article of luggage on the wheel assembly. Opposing ends are connected to the base, which are foldable to the base for storage of the article of luggage. Opposing sides are connected to the base and the opposing ends, the sides formed of a deformable material to allow folding of the ends to the base for storage. A top is connectable to the opposing sides and the opposing ends, the top including a lid formed of a deformable material. A reinforcing frame member extends substantially around a periphery of the deformable lid, so that the article of luggage may be stood on one of the opposing ends such that another of the ends is at least partially supported by the reinforcing frame member.

The top may be formed completely by the lid. The reinforcing member may be formed of rigid plastic material. The lid may be hingedly attached to one of the opposing sides. The foldable end may include a hinge to allow folding of the end to the base. A foot may be provided on one of the opposing ends for stabilization of the article when stood on the end.

DETAILED DESCRIPTION OF THE INVENTION

Figure 1:
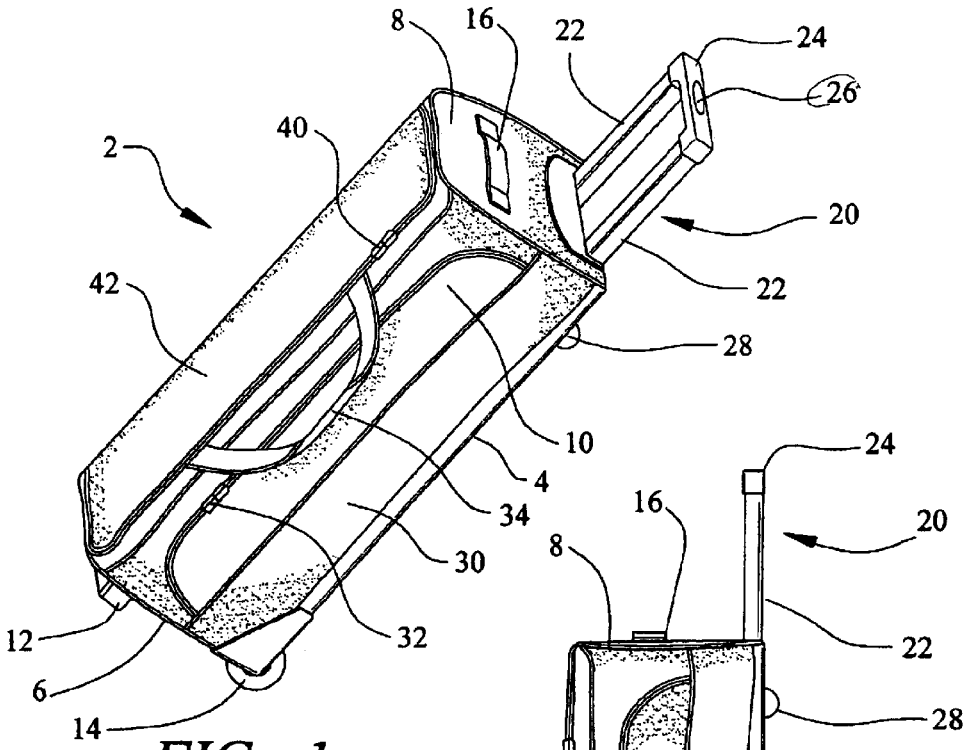
FIG. 1 is a side perspective view of an embodiment of an article of luggage according to the invention in a towing position.
Figure 2:
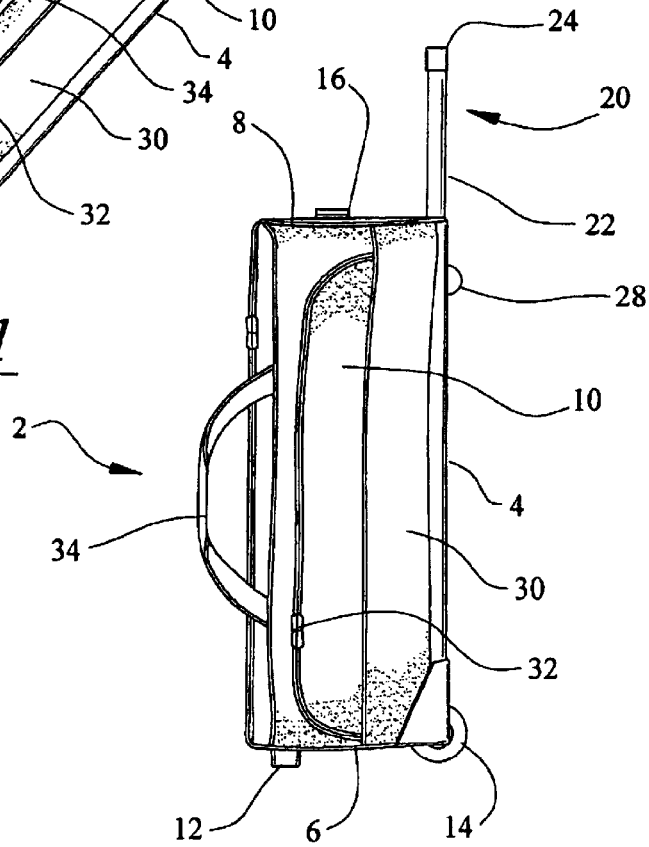
FIG. 2 is a side perspective view of an embodiment of an article of luggage according to the invention in a standing position.
Figure 3:
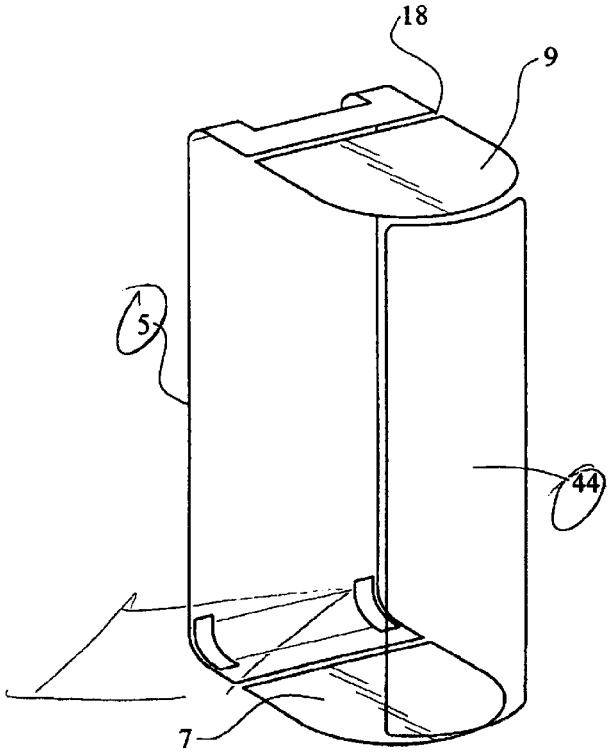
FIG. 3 is a perspective view showing rigid inserts for an embodiment of an article of luggage according to the invention in a standing position.
Figure 4:
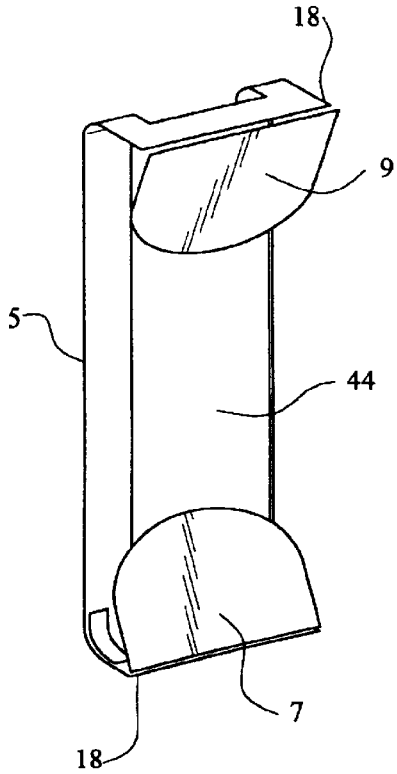
FIG. 4 is a perspective showing rigid inserts for an embodiment of an article of luggage according to the invention in a standing position, showing a folded configuration.
Figure 5:
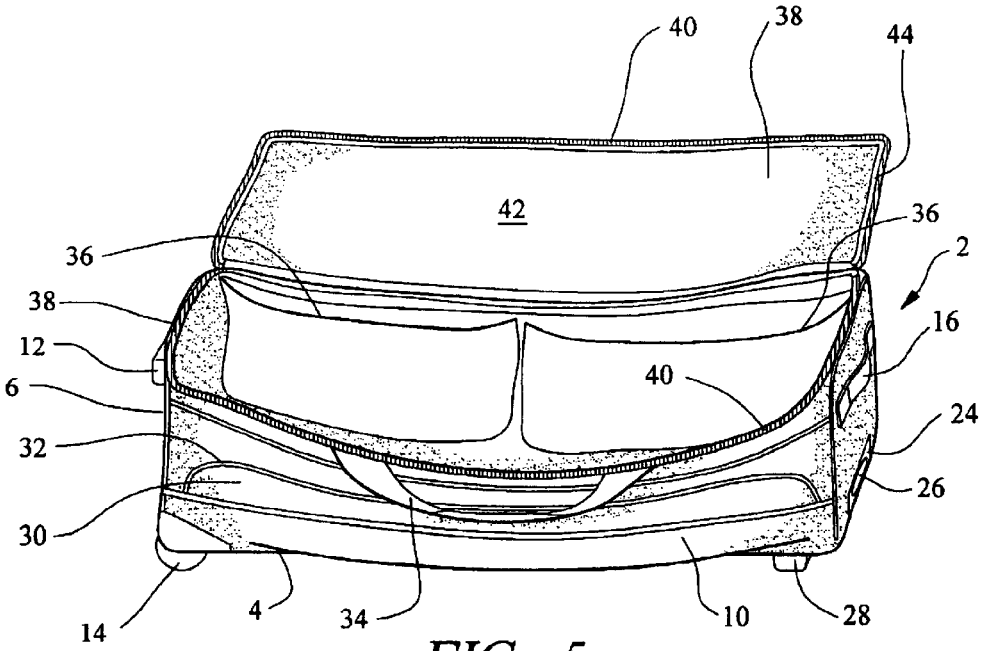
FIG. 5 is a side perspective view of an embodiment of an article of luggage according to the invention in an open position for filling with items.

Referring now to the drawings, and more particularly to FIGS. 1, 2 and 5–7, an article of luggage 2 is illustrated. The article of luggage 2 is a rolling duffel in the illustrated embodiment, although it will be appreciated that the invention is not necessarily limited to use with a rolling duffel and may be applicable to a non-wheeled duffel bag or any other article of luggage having flexible sides and a flexible lid. FIGS. 3, 4 and 8 illustrate rigid or semi-rigid inserts to the article of luggage 2.

The article of luggage 2 may include a base 4 which may be formed of a reinforced or stiff material, or of any suitable material. Alternatively, the base 4 may include a rigid base insert 5 covered in a flexible material. Ends 6 and 8 may be connected to the base, with sides 10 extending between the ends. The ends 6 and 8 may be formed of a flexible material or of a rigid material, or of any suitable material. Examples of suitable rigid material for forming the ends 6 and 8 include honeycomb board and PE board. The end 6 may include a foot 12 and wheels 14. The foot 12 enables the article of luggage 12 to be stood with end 6 forming the base of the article. The end 8 may include a handle 16 to enable the article to be picked up.

Figure 7:
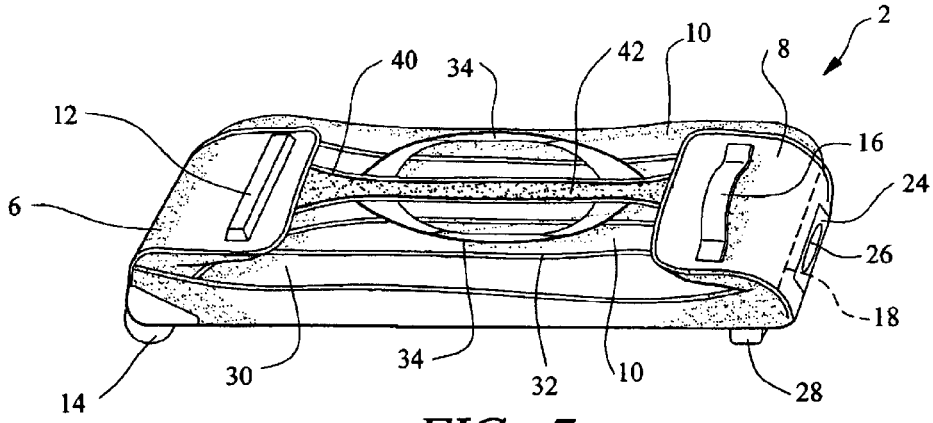
FIG. 7 is a side perspective view of an embodiment of an article of luggage according to the invention in a folded condition.
Figure 8A:
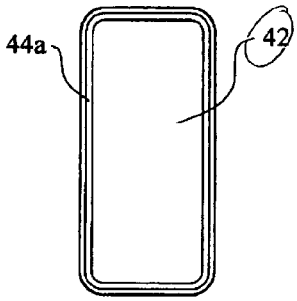
FIGS. 8*a*–8*f* are views of different embodiments of reinforcing members according to the invention.
Figure 8B:
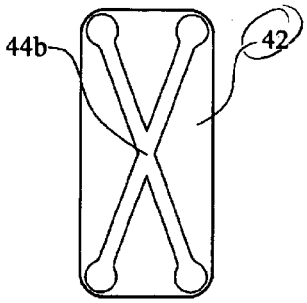
Figure 8C:
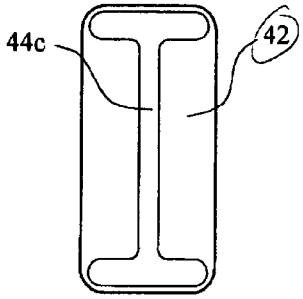
Figure 8D:
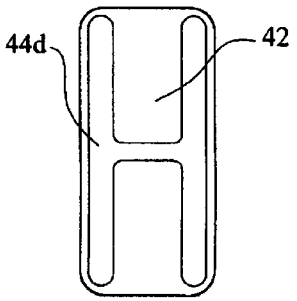
Figure 8E:
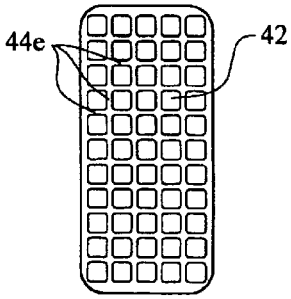
Figure 8F:
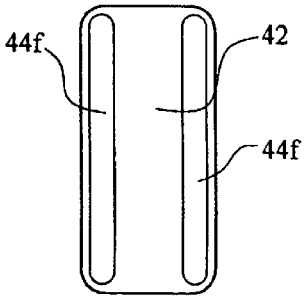

In a preferred embodiment, the ends 6 and 8 may include hinges 18 allowing the ends 6 and 8 to be folded flat for storage, as can be seen most clearly in FIGS. 4 and 7. The hinges 18 may be formed by gaps between rigid inserts, such as inserts 7 and 9, and a base insert 5, with the ends 6 and 8 formed of a flexible material. The flexible material covering the gaps between rigid inserts thus forms a hinge. Alternatively, the ends 6 and 8 may be formed of a flexible material that may be folded, compressed or crumpled flat for storage. Yet another alternative is for the ends 6 and 8 to be formed of a stiff material, or to have a reinforcing member therein, the ends 6 and 8 being flexible near to the base 4 for folding. A further alternative is for the ends 6 and 8 to have a removable reinforcing member for folding. Yet a further alternative is that the ends 6 and 8 are not foldable for storage.

The article of luggage 2 also preferably comprises an adjustable handle system 20. The adjustable handle system 20 preferably comprises two extendable and retractable vertical members 22 having a horizontal handle portion 24 coupled between a top portion of the vertical members 22. A locking button 26 may be located on the horizontal handle portion 24 to enable the adjustable handle system 20 to be locked into a stowed position or into an extended position. The article of luggage 2 may be towed on the wheels 14 using the adjustable handle system 20. If the article of luggage 2 is a duffel bag, which are typically longer than suitcases, the vertical members 22 may be shorter than those typically used with suitcases in order to locate the handle portion 24 at an appropriate position for towing. One or more feet 28 may be attached to the base 4, or may be part of the adjustable handle system 20. The feet 28 allow the article of luggage 2 to be placed flat on the base 4 without the base 4 tipping downwardly towards the end 8 due to the wheels 14.

The sides 10 are preferably formed of a flexible, lightweight material, but any suitable material may be employed. If the sides 10 are flexible, they may enable the article of luggage 2 to be folded flat for storage. One or more pockets 30 may be provided on the exterior of sides 10, or on any suitable location on the article of luggage 2. The pockets 30 may be opened and closed by means of zipperpers 32, but any suitable fastener may be used. Alternatively, the pockets 30 may simply be open at their tops and not be fastenable. One or more handles 34 may be attached to the sides 10 so that the article of luggage 2 may be picked up like a conventional duffel bag. One or more pockets 36 may be provided on the interior of sides 10, within the article of luggage 2.

In one embodiment, a top 38 is attached to one of the sides 10, and is fastenable to close the article of luggage 2. The top 38 may have a zipper 40 extending around 3 sides thereof so that the top 38 may be hinged at its attached side. Alternatively, the zipper 40 may extend around a portion of the top 38 to form a lid 42 that forms only a portion of the top 38. However, it will be appreciated that any form of top 38 may be employed. For example, the zipper 40 could extend around the entire periphery of the top 38 so that the top 38 may be removed. Alternatively, any other form of fastener such as hook and loop fasteners or snap fasteners may be employed to close the top 38.

The top 38 is preferably formed of a flexible, lightweight material, and has a reinforcing member 44 extending substantially along the length of the top 38. As illustrated in FIGS. 8A–8F, the reinforcing member 44 can take any suitable form. For example, the reinforcing member 44*a* may extend around the periphery of the top 38 or lid 42. Alternatively, the reinforcing member 44*b* may form a cross, extending between the corners of the top 38 or lid 42, or between the sides of the top 38 or lid 42. Another alternative is for the reinforcing member 44*c* to have a I-shape, or an H-shape, designated 44*d*. A further alternative is for the reinforcing member 44*e* to have a mesh or trellis pattern. Yet a further alternative is for the reinforcing member 44*f* to extend along the length of the top 38. It will be appreciated that the reinforcing member 44 does not need to be located within the lid 42, but may be located outside the lid, for example, along the edges of top 38.

It is not necessary to have the reinforcing member extending along the entire length of the top 38, as a small amount of sagging can be permitted without the article of luggage 2 tipping over when stood in an upright position. The exact length can be determined by experimentation.

The reinforcing member 44 is preferably formed of a rigid metal or plastic material, but may be of any suitable rigid material. Some flexibility may be included in reinforcing member 44 so that the article of luggage 2 may be easily folded for storage. The reinforcing member 44 allows the article of luggage 2 to be stood on the end 6, with the reinforcing member 44 helping to support the weight of the end 8, and hence allows the article of luggage 2 to be stood upright without support.

Figure 6:
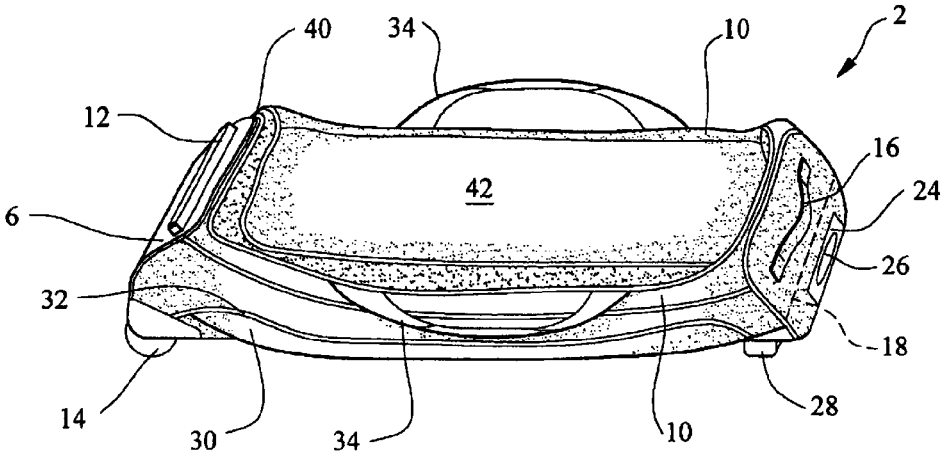
FIG. 6 is a side perspective view of an embodiment of an article of luggage according to the invention in a partially folded condition.

In order to fold the article of luggage 2 for storage, the lid 42 can be placed into the interior of the article of luggage 2, as shown in FIG. 6. The sides 10 may then be folded or crumpled inwardly, as shown in FIG. 7, and finally the ends 6 and 8 can be folded on top of the sides 10. A fastener (not shown) may be included to help retain the article of luggage 2 in the folded configuration.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

What is claimed is:

1. A collapsible article of luggage comprising:

a base having at least one rigid base reinforcing member;

opposing end panels connected to said base at opposing ends thereof, each of said opposing end panels formed of a material having a rigid reinforcement and having a hinge portion to facilitate moving said opposing end panels from a first position perpendicular to said base to a second position folded inwardly toward said base;

opposing sides, each including a boss edge portion defined where said opposing sides are connected to said base, a top edge portion defined where said opposing sides are connected to a top, and a pair of end edge portions defined where said opposing sides are connected to said opposing end panels, said sides formed of a deformable material devoid of any rigid support structure extending from said base edge portion to said top edge portion, and collapsible from an upright position perpendicular to said base, to a stowed position wherein said opposing sides are collapsed toward said base;

wheels located adjacent said base and one of said opposing ends;

an extendable and retractable handle member provided adjacent said base for towing said article on said wheels;

said top including a lid formed of a deformable material, and a top rigid reinforcing member extending substantially along the length of the top between said opposing end panels, wherein said top rigid reinforcing member prevents said opposing end panels from sagging toward one another when said article is stood on one of said opposing end panels.

2. The article of luggage of claim 1, wherein said top is formed completely by said lid.

3. The article of luggage of claim 2, wherein said top rigid reinforcing member extends substantially along the length of said lid.

4. The article of luggage according to claim 3, wherein said top rigid reinforcing member is a frame extending around the periphery of said lid.

5. The article of luggage according to claim 1, wherein said top rigid reinforcing member is formed of rigid plastic material.

6. The article at luggage according to claim 1, wherein said lid is hingedly attached to one of said opposing sides.

7. The article of luggage according to claim 1, further comprising a foot provided on one of said opposing ends for stabilization of said article when stood on said end.

8. A collapsible article of luggage comprising:

a substantially rigid base;

a wheel assembly connected to said base;

a retractable handle assembly connected to said base for towing the article of luggage on said wheel assembly;

opposing end panels connected to said base, each of said opposing end panels formed of a material having a rigid reinforcement and having a hinge portion to facilitate moving said opposing end panels from a first position perpendicular to said base to a second position folded inwardly toward said base;

opposing sides, each including a base edge portion defined where said opposing sides are connected to said base, a top edge portion defined where said opposing sides are connected to a top, and a pair of end edge portions defined where said opposing sides are connected to said opposing end panels, said sides formed of a deformable material devoid of any rigid support structure extending from said base edge portion to said top edge portion, and collapsible from an upright position perpendicular to said base, to a stowed position wherein said opposing sides are collapsed toward said base to allow folding of said ends to said base for storage;

said top including a lid formed of a deformable material, and wherein a rigid reinforcing frame member extends substantially around a periphery of said deformable lid, whereby said article may be stood on one of said opposing end panels such that another of said ends is at least partially supported by said reinforcing frame member.

9. The article of luggage of claim 8, wherein said top is formed completely by said lid.

10. The article of luggage according to claim 8, wherein said rigid reinforcing member is formed of rigid plastic material.

11. The article of luggage according to claim 8, wherein said lid is hingedly attached to one of said opposing sides.

12. The article of luggage according to claim 8, further comprising a foot provided on one of said opposing end panels for stabilization of said article when stood on said end panel.

13. A collapsible article of luggage comprising:

a base having at least one rigid base reinforcing member;

opposing end panels connected to said base at opposing ends thereof, each of said opposing end panels formed of a material having a rigid reinforcement and having a hinge portion to facilitate moving said opposing end panels from a first position perpendicular to said base to a second position folded inwardly toward said base;

opposing sides, each including a base edge portion defined where said opposing sides are connected to said base, a top edge portion defined where said opposing sides are connected to a top, and a pair of end edge portions defined where said opposing sides are connected to said opposing end panels, said sides formed of a deformable material devoid of any rigid support structure extending from said base edge portion to said top edge portion, and collapsible from an upright position perpendicular to said base, to a stowed position wherein said opposing sides are collapsed toward said base;

said top including a lid formed of a deformable material, and a top rigid reinforcing member extending substantially along the length of the top between said opposing end panels, wherein said top rigid reinforcing member prevents said opposing end panels from sagging toward one another when said article is stood on one of said opposing end panels, and wherein said top is formed completely by said lid; and wherein said top rigid reinforcing member is a frame extending around the periphery of said lid.

14. A collapsible article of luggage comprising:

a base having at least one rigid base reinforcing member;

opposing end panels connected to said base at opposing ends thereof, each of said opposing end panels formed of a material having a rigid reinforcement and having a hinge portion to facilitate moving said opposing end panels from a first position perpendicular to said base to a second position folded inwardly toward said base;

opposing sides, each including a base edge portion defined where said opposing sides are connected to said base, a top edge portion defined where said opposing sides are connected to a top, and a pair of end edge portions defined where said opposing sides are connected to said opposing end panels said sides formed of a deformable material devoid of any rigid support structure extending from said base edge portion to said top edge portion, and collapsible from an upright position perpendicular to said base, to a stowed position wherein said opposing sides are collapsed toward said base;

said top including a lid formed of a deformable material, and a top rigid reinforcing member extending substantially along the length of the top between said opposing end panels, wherein said tap rigid reinforcing member prevents said opposing end panels from sagging toward one another when said article is stood on one of said opposing end panels, and wherein said top is formed completely by said lid;

wheels located adjacent said base and one of said opposing ends;

further comprising an extendable and retractable handle member provided adjacent said base for towing said article on said wheels.

* * * * *

UNITED STATES PATENT AND TRADEMARK OFFICE

CERTIFICATE OF CORRECTION

PATENT NO. : 6,926,129 B2
DATED : August 9, 2005
INVENTOR(S) : Hoberman

It is certified that error appears in the above-identified patent and that said Letters Patent is hereby corrected as shown below:

Column 5,
Line 1, delete “boss” and replace with -- base --.

Column 7,
Line 4, delete “tap” and replace with -- top --.

Signed and Sealed this

Third Day of January, 2006

JON W. DUDAS
*Director of the United States Patent and Trademark Office*